US007661851B2

(12) United States Patent
Karelic et al.

(10) Patent No.: US 7,661,851 B2
(45) Date of Patent: Feb. 16, 2010

(54) DECORATIVE LAMP AND METHOD OF MANUFACTURE

(76) Inventors: Jorge Karelic, 8 Sharari St, Tel Aviv (IL); Paula Karelic, Plaza Dr Letamendi 36 pral 2, 08007 Barcelona (ES)

( * ) Notice: Subject to any disclaimer, the term of this patent is extended or adjusted under 35 U.S.C. 154(b) by 0 days.

(21) Appl. No.: 12/080,560

(22) Filed: Apr. 4, 2008

(65) Prior Publication Data

US 2008/0266882 A1 Oct. 30, 2008

(51) Int. Cl.
*F21V 1/00* (2006.01)

(52) U.S. Cl. ..... 362/355; 362/311.03; 362/311.13; 362/351

(58) Field of Classification Search ..... 362/311, 362/351, 355, 361, 806, 311.03, 311.13
See application file for complete search history.

(56) References Cited

U.S. PATENT DOCUMENTS 3,456,106 A * 7/1969 Gluschkin ..... 362/98
4,268,896 A * 5/1981 Mann ..... 362/311
5,975,725 A * 11/1999 Ireland-Stacy ..... 362/357
6,742,915 B1 * 6/2004 Westerheide ..... 362/360

* cited by examiner

*Primary Examiner*—Laura Tso

(57) ABSTRACT

The present invention relates to a decorative lamp comprising a source of light and a shade of a translucent or semi-opaque porcelain material and its manufacturing method. The lamp further includes at least one decorative element of a material of greater opaqueness than that of the porcelain shade located on an inside interior surface of the shade to block the passage of light to reveal its form when the source of light is turned-on and not being visible to the naked eye.

13 Claims, 3 Drawing Sheets

DECORATIVE LAMP AND METHOD OF MANUFACTURE

FIELD OF INVENTION

This invention relates to the field of decorative lamps in which the source of light is surrounded by a translucent shade containing decorative design patterns visible to the naked eye when the lamp light source is on but not visible to the naked eye when the lamp light source is off.

BACKGROUND

Decorative and/or ornamental lamps are distinguishable from conventional lamps in that the shade of an ornamental lamp contains ornamental designs formed on the shade using e.g., decorative elements which may be integral to the shade, coated or laminated on the shade or pasted on the shade. Decals may be used as the decorative elements. Fabric shades are commercially available to form a decorative lamp that have prints or paintings on their surface with ornamental designs or decorations.

Other lamp shades are also known in the prior art which have decorative elements formed on the shade's surface visible to the eye independent of whether the lamp light source is on or off, i.e., whether the lamp light source is connected to a source of power or disconnected from the source of power. The orifices and orifice designs in the shade will be visible to the naked eye whether the lamp light is turned on or turned off. This is a common characteristic of all prior art decorative lamps in that the decorative elements or designs in the shade are visible to the naked eye independent of whether the lamp is on or off. In this regard the general appearance of all of the prior art decorative lamps do not substantially vary to the naked eye independent of whether the lamp is on or off.

SUMMARY OF THE INVENTION

The present invention is directed to a decorative or ornamental lamp and method in which decorative elemental designs are present on the shade and visible to the naked eye when the lamp is turned on but when the lamp is turned off at least part or all of the decorative elements become non-visible to the naked eye.

The decorative lamp of the present invention comprises a source of light adapted to be turned on or turned off and a lamp shade surrounding the source of light, with the lamp shade composed of a porcelain material which is either translucent or semi-opaque such that light is able to pass from the source of light through the shade when the source of light is turned on and includes at least one decorative element in a defined shape located on an interior surface of the shade composed of a material having an opaqueness greater than that of the porcelain shade such that the decorative element(s) will be visible to the naked eye from a location external of the lamp when the source of light is turned on but will not be visible to the naked eye when the source of light is turned off.

BRIEF DESCRIPTION OF THE DRAWINGS

A better understanding of the present invention will be realized from the following detailed description of various exemplary embodiments of the invention when read in conjunction with the accompanying drawings describing the embodiments of the invention as shown in the drawings in which.

DETAILED DESCRIPTION OF THE PREFERRED EMBODIMENTS

The present invention relates to a decorative lamp and to the method of fabrication with the decorative lamp 10 shown in all of the Figures comprising a source of light 2, which may be represented, for example, by a light bulb, and a shade 1 surrounding the source of light 2. The shade 1 is composed of a translucent or semi-opaque material. The source of light 2 is connected to an external source of power (not shown) through a manual switch (not shown) so that when the lamp 10 is turned on the lamp 10 is in the "turned on" mode of operation and when the lamp 10 is turned off the lamp is in the "turned off" mode of operation.

Figure 1:
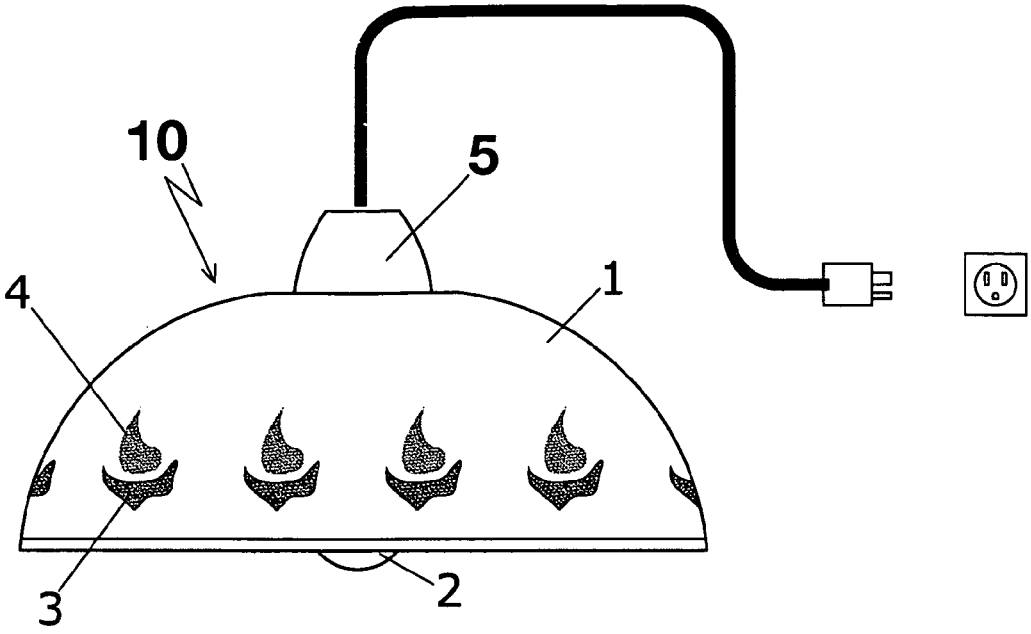
FIG. 1 is a schematic representation of one embodiment of the present invention in which an ornamental lamp is shown having a shade with decorative figures on both the internal and external faces of the shade and with the lamp in a turned-on mode of operation.
Figure 2:
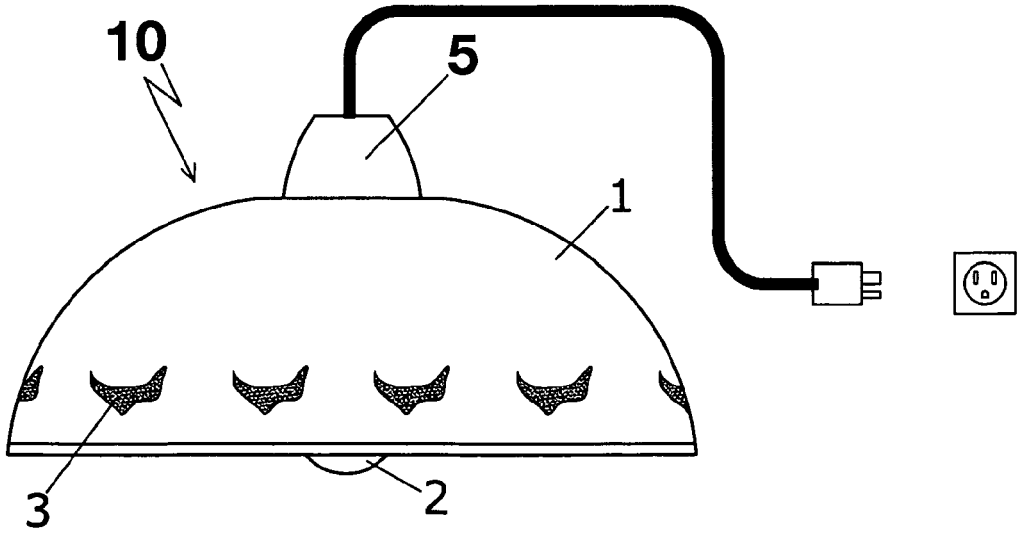
FIG. 2 is a schematic representation of the lamp corresponding to FIG. 1 with the lamp in the turned off mode of operation.

The shade 1 in decorative lamp 10 of the present invention in the embodiment of FIG. 1 contains external decorative elements 3 located on the outermost surface of the shade 1 and internal decorative elements 4 located on an innermost surface of the shade 1 adjacent to the light bulb 2. The external decorative elements 3 will be visible to the naked eye in both the "turned on" mode of operation and "turned off" mode of operation. However, when the lamp 10 is turned off, as is represented by FIG. 2, the internal decorative elements 4 are not visible to the naked eye.

The word lamp as used in the present invention is understood to include ceiling lamps, standing lamps, table lamps, candle holders, wall panels and lighting fixtures all of which include a source of light 2 and a shade 1 which filters light emitted by the source of light 2 when the lamp 10 is turned on.

The shade 1 of the present invention should be composed of a ceramic porcelain of any conventional composition and preferably should be of a thickness in a thickness range of between about 1.5 mm to 5 mm. Porcelain is a conventional ceramic material which is white in color and is either naturally opaque or semi-opaque. It is essentially made of Kaolin, feldspar and quartz, and will be opaque or semi-opaque except in cases of where the thickness is substantially greater than 5 mm. It is understood that depending on the exact composition of the porcelain and thickness the degree of translucency will vary.

The porcelain shade 1 of the present invention should include one or more decorative elements 4 composed of a material of greater opaqueness than that of the shade located on the inside surface of the shade 1 located nearest the source of light 2. When the lamp 10 is turned on the opaque decorative elements 4 on the inside of the shade 1 inhibit or block the passing of light to reveal the form or shape of the element 4. The elements 4 may have many decorative forms or shapes so that when the light source 2 is turned on, these decorative elements 4 are revealed showing their form to the naked eye from any location external of the lamp 10. In contrast when the lamp 10 is turned off, the opaque decorative elements 4 cannot be seen by the naked eye. The decorative opaque elements 4, by being located in or on the surface of the shade 1 adjacent to the source of light 2 and being more opaque than the porcelain shade 1 will not be visible from outside the lamp unless the lamp 10 is turned on. Thus only when the lamp 10 is turned on will the decorative elements 4 be visible due to the fact that the elements 4 are more opaque then that of the porcelain shade 1.

Figure 3:
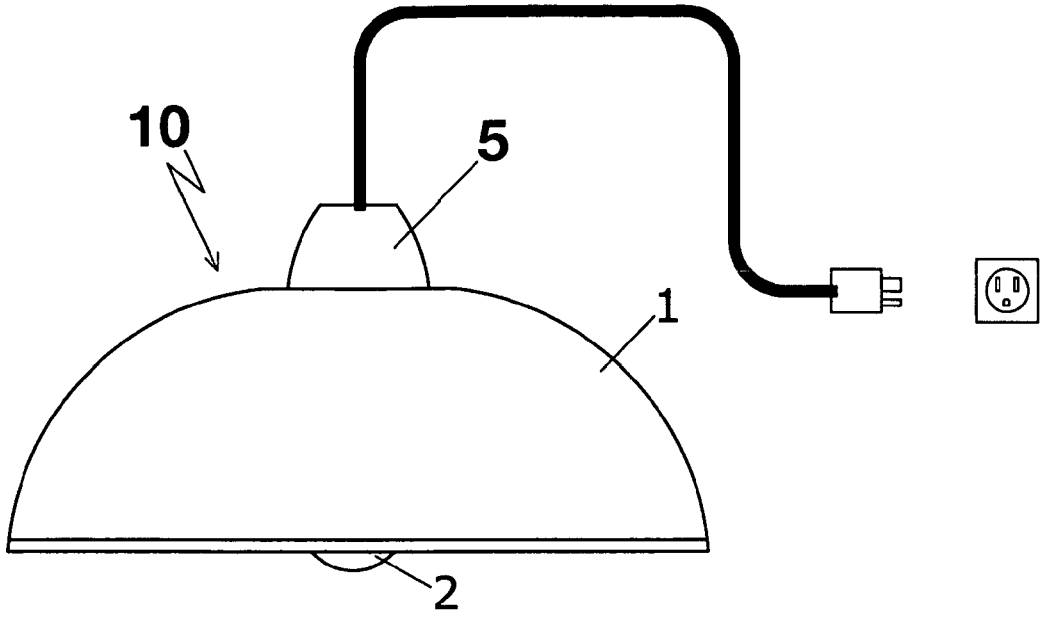
FIG. 3 is a schematic representation of the lamp corresponding to FIGS. 1 and 2 but with only decorative FIG. 4 present on the inside or internal face of the lamp and with the lamp in the turned off mode of operation.
Figure 4:
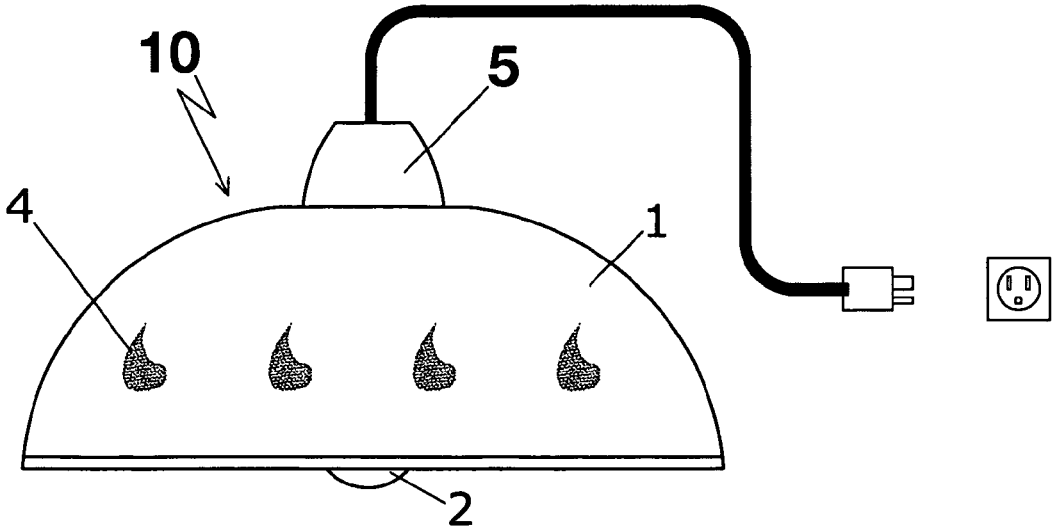
FIG. 4 is a schematic representation of the lamp corresponding to FIG. 3 with the lamp in the turned-on mode of operation.

If the shade 1 also contains decorative elements 3 on the exterior surface of the shade 1 these decorative elements 3 will be exposed to the naked eye when the lamp 10 is turned on as is shown in FIG. 1 or when the lamp 10 is turned off as shown in FIG. 2. However, without the decorative elements 3 as shown in FIG. 3 nothing is visible to the naked eye when the lamp 10 is turned off.

Accordingly, when the lamp 10 is turned on the decorative elements 4 become visible substantially changing the appearance of the lamp 10 whether the lamp 10 contains the decorative elements 3 on its exterior surface or not. The decorative elements 3 are visible independent of the mode of operation of the lamp as shown in FIGS. 1 and 2 but the elements 4 require the lamp 10 to be turned on to expose the design of the elements 4.

The internal decorative opaque elements 4 are preferably laminated decalcomania with their shapes revealed only when the source of light 2 is turned on and are hidden in the internal part of the shade when the source of light 2 is turned off. Moreover, although the decorative elements 4 will block light when the source of light 2 is turned on the borders of the internal laminate (4) may appear blurred achieving a greater decorative effect in that the transition is not sharply visible. Laminated decorative opaque elements 4 may also achieve a highly esthetic effect different than placing the opaque element over the outside surface of the shade, since in this case not only are the decorative elements appreciated but also by laminating the elements 4 directly onto the shade 1 they become more environmentally friendly.

Figure 5:
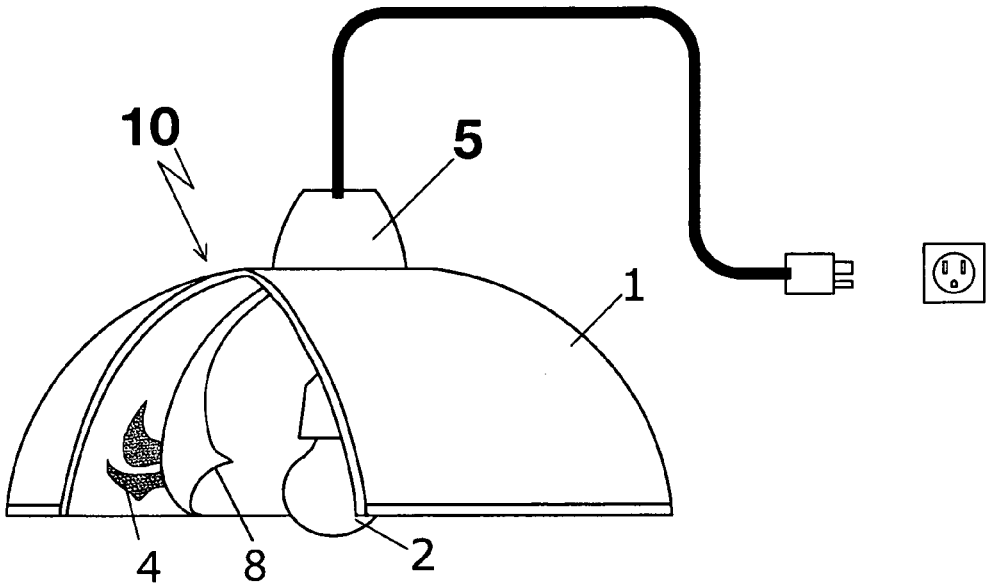
FIG. 5 is a schematic representation of another embodiment of the ornamental lamp of the present invention shown in the turned off mode of operation and with the shade being shown partially cut-away to expose decorative figures located on an interior layer of the shade hidden beneath a layer facing the shade which does not contain decorative figures and is more opaque than the interior layer containing the decorative figures.
Figure 6:
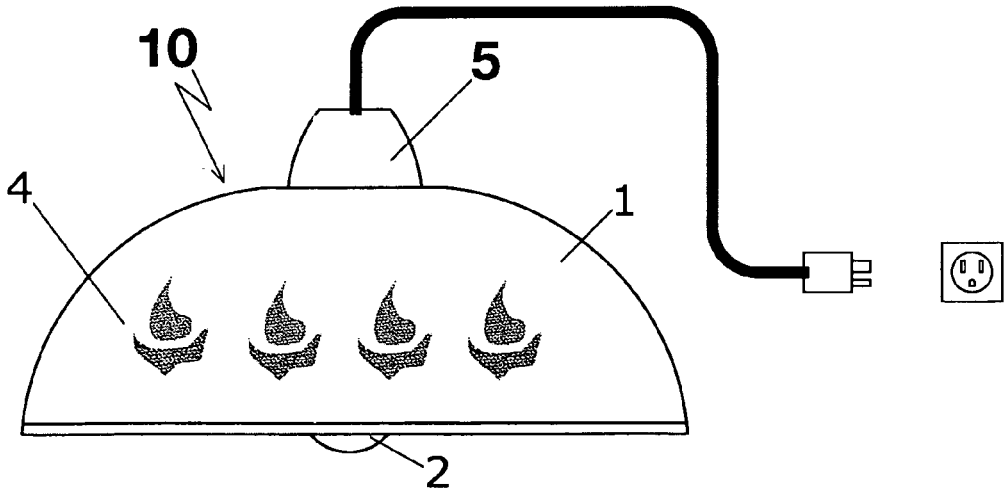
FIG. 6 is a schematic representation of the ornamental lamp of FIG. 5 with the lamp shown in the turned on mode of operation.

In order to avoid seeing the internal decorative elements 4 even from the internal side of the shade 1, it is possible to cover the shade 1 internally with an additional opaque laminate. An additional laminate 8 can be used to cover the entire internal face of the shade 1 as shown in the embodiment of FIGS. 5 and 6 or to partially cover only a limited area (not shown) defined by the decorative elements 4. With this additional laminate 8 it is possible to increase the surprise effect of the decoration of the shade 1 when the light 2 is turned on. The additional laminate 8 may be of a similar color to the porcelain, e.g. white, in a manner that avoids projecting the borders of the decorative elements 4 when the light is turned on.

A porcelain shade 1 for an ornamental lamp is manufactured in accordance with the present invention by practicing the following process stages:

Stage 1: Molding the porcelain into a desired shade of a given geometrical shape and configuration and subsequently drying the shade;

Stage 2: Firing the porcelain in a kiln;

Stage 3: Applying decalcomanias defining decorative elements onto the internal side of the shade representing the inner face of the shade 1 surrounding the source of light 2; and Stage 4: Re-firing the porcelain in the kiln.

The first stage of the process is carried out in a mold into which the porcelain is poured and then dried at room temperature. It is later fired in a kiln to obtain the desired geometrical shape. However two firings may occur between stages one and two to cause a glazing effect. Afterwards the decalcomanias are applied to the internal side of the shade corresponding to the side facing or adjacent to the source of light. It is then fired again in the kiln to get the finished shade. Finally a conventional lamp holder 5 is affixed to the shade 1.

In the preferred process decorative laminated elements 4 may be glued to the shade 1 on the side of the shade 1 adjacent to the source of light 2 whereas in stage 3 the porcelain may be again fired in a finishing stage. However, after the first stage of firing an intermediate second stage of firing may take place to achieve a glazing effect. More specifically, in the case when there are only two stages of firing in the kiln the porcelain will be rustic without glazing.

For lamps without glazing the first stage of firing should occur preferably between 1,200-1,800° Celsius with the final second firing stage at a preferred temperature between 750-850° Celsius whereas if an intermediate additional glazing step is used the first stage of firing preferably occurs between 920-1,400° Celsius, the second firing occurs at a temperature between 1200-1400° Celsius and the finishing firing step occurs at a temperature between 750-850° Celsius. If an additional laminated layer 8 is placed over the inner layer containing the internal decorative elements 4 this step should occur after stage 3 and before the last firing. When decals are used as the decorative elements, the decals can be applied directly using water alone and the porcelain shade requires an additional firing step if a glazing firing is used. However, if the decal is applied using a glue and fired e.g., at 1200° Celsius no additional firing is needed for glazing of the porcelain shade.

When decorative elements are applied to exterior of the shade 1, they are preferably applied also between the first and fourth stages, i.e., between the first and the finished second firing.

It should be further understood that because of the porcelain shade of the present invention, when the lamp is turned off general illumination in the room emitted from light sources other than from the decorative lamp will not cause the interior decorative elements to reveal their decorative pattern.

What is claimed is:

1. A decorative lamp comprising a source of light adapted to be turned on or turned off and a single lamp shade surrounding the source of light, with the lamp shade composed of a porcelain body having a material composition which is either translucent or semi-opaque such that white light is able to pass from the source of light uniformily through the porcelain body when the source of light is turned on and having a plurality of decorative elements each in a defined shape specially distributed on the interior surface of the shade at selected locations for diffusing the passage of light through only the decorative elements without affecting the passage of light in all other areas of the porcelain body with each of decorative elements being composed of a material having an opaqueness greater than the opaqueness of the porcelain shade such that the decorative element(s) will be visible to the naked eye from a location external of the lamp when the source of light is turned on but will not be visible to the naked eye when the source of light is turned off.

2. A decorative lamp as defined in claim 1 further comprising one or more decorative elements on the outside surface of the porcelain lamp shade such that when the source of light is turned on the decorative elements on both the interior surface and on the outside surface will be visible to the naked eye but when the source of light is turned off only the decorative elements on the outside surface will be visible.

3. A decorative lamp as defined in claim 1 wherein the decorative elements on the interior surface of the wall consist of a design laminated upon the interior surface.

4. A decorative lamp as defined in claim 3 further comprising an additional opaque laminate covering the decorative element on the interior surface such that the decorative element cannot be seen from the internal side of the shade.

5. A decorative lamp as defined in claim 4 wherein the additional opaque laminate covers the entire innermost surface of the shade adjacent the source of light.

6. A decorative lamp as defined in claim 5 wherein the additional laminate is of a color substantially the same as the color to the outside surface of the porcelain shade.

7. A method of manufacturing a shade to from a decorative lamp comprising the steps of fabricating a lamp shade composed of porcelain into a desired shape having an interior surface and an exterior surface and drying the lamp shade; firing the porcelain shade in a kiln before applying first decalcomanias having a desired decorative geometry and shape to the interior surface of the lamp shade; and re-firing the porcelain shade.

8. A method as defined in claim 7 wherein the porcelain shade is first fired at a temperature of between 1,200-1,800° Celsius.

9. A method as defined in claim 8 wherein the porcelain shade is refired at a temperature of between 750-850° Celsius.

10. A method as defined in claim 7 further comprising applying second decalcomanias having a desired decorative geometry and shape to either the outside or inside surface of the lamp shade.

11. A method as defined in claim 10 wherein the second decalcomanias are applied to the outside surface of the lamp shade after the first firing of the porcelain shade.

12. A decorative lamp as defined in claim 7 further comprising an additional firing step between the first firing step and the second firing step.

13. A decorative lamp as defined in claim 12 wherein the porcelain shade is first fired at a temperature of between 920-1,400° Celsius and the finishing firing step occurs at a temperature between 750-850° Celsius.

* * * * *